US005597287A

United States Patent [19]

Helmick

[11] Patent Number: 5,597,287

[45] Date of Patent: Jan. 28, 1997

[54] ROTARY COMPRESSOR WITH PULSATION MINIMIZING DISCHARGE

[75] Inventor: Richard L. Helmick, Severn, Md.

[73] Assignee: The United States of America as represented by the Secretary of the Navy, Washington, D.C.

[21] Appl. No.: 515,878

[22] Filed: Aug. 16, 1995

[51] Int. Cl.[6] ..... F04D 29/66

[52] U.S. Cl. ..... 415/119; 415/146; 415/206; 181/403

[58] Field of Search ..... 415/146, 203, 415/204, 206, 207, 208.1, 208.2, 208.3, 211.2, 119; 181/403, 229

[56] References Cited

U.S. PATENT DOCUMENTS

| | | | |
|---|---|---|---|
| 2,803,396 | 8/1957 | Darrow | 415/146 |
| 4,378,194 | 3/1983 | Bandukwalla | 415/146 |
| 4,869,642 | 9/1989 | Williamson | 415/146 |
| 4,998,861 | 3/1991 | Fukuzawa et al. | 415/206 |
| 5,156,524 | 10/1992 | Forni | 415/206 |

FOREIGN PATENT DOCUMENTS 1108253 8/1984 U.S.S.R. .

*Primary Examiner*—John T. Kwon
*Attorney, Agent, or Firm*—John Forrest; Jacob Shuster

[57] ABSTRACT

Fluent material is discharged with a radial velocity component from outlet ports of a positive displacement compressor for flow through a continuous volute passage to a receiver. The volute passage has a flow path geometry arranged to both minimize pulsations of the fluent material delivered to the receiver and optimize operation of the compressor.

14 Claims, 1 Drawing Sheet

ROTARY COMPRESSOR WITH PULSATION MINIMIZING DISCHARGE

BACKGROUND OF THE INVENTION

The present invention relates generally to a positive displacement type of rotary compressor from which fluids are centrifugally driven for discharge into a receiver.

Rotary compressors having single screw type of bladed rotors for pressurized discharge of a fluent material such as refrigerant, are generally known in the art. Such compressors impart a radial velocity component to the refrigerant being pressurized for flow to the condenser of a refrigeration system, as the receiver for example. Accordingly the pressurized refrigerant when delivered to the receiver by compressor discharge porting along a flow path having sharp turns, results in pulsation induced vibration noise dependent on the rotor blade threading and rotor driving frequency.

In an effort to deal with the foregoing pulsation noise problem, diffusers and discharge mufflers have been proposed for rotary compressors, as disclosed for example in U.S. Pat. Nos. 4,330,239, 5,205,719 and 5,249,919 to Gannaway, Childs et al. and Sishtla et al., respectively. However, such prior art muffler arrangements introduce other flow path problems which adversely affect efficient compressor operation.

It is therefore an important object of the present invention to provide a rotary type of positive displacement compressor from which pulsations are minimized to reduce vibrations while maintaining optimized operation under different installational conditions.

SUMMARY OF THE INVENTION

In accordance with the present invention, the foregoing rotary type of positive displacement compressor is provided with a discharge muffler through which fluids pressurized by rotation of a single screw bladed rotor are conducted to the receiver along a single continuous volute-shaped flow passage having a flow path geometry tailored to both minimize pulsations and optimize operation. Toward that end, the volute flow passage may be provided with a diffuser portion for converting kinetic energy into pressure of the fluid discharged with a radial velocity component from the rotor housing of the compressor. Also, the geometry of the volute-shaped passage flow path may be adjustably changed to accommodate different installational conditions for optimized compressor operation.

BRIEF DESCRIPTION OF DRAWING FIGURES

A more complete appreciation of the invention and many of its attendant advantages will be readily appreciated as the same becomes better understood by reference to the following detailed description when considered in connection with the accompanying drawing wherein:

FIG. 1 is a partial side section view of a compressor constructed in accordance with one embodiment of the invention for a refrigeration system installation as also diagrammed; and FIG. 2 is a transverse section view through the compressor taken substantially through a plane indicated by section line 2—2 in FIG. 1.

DETAILED DESCRIPTION OF PREFERRED EMBODIMENTS

Figure 1:
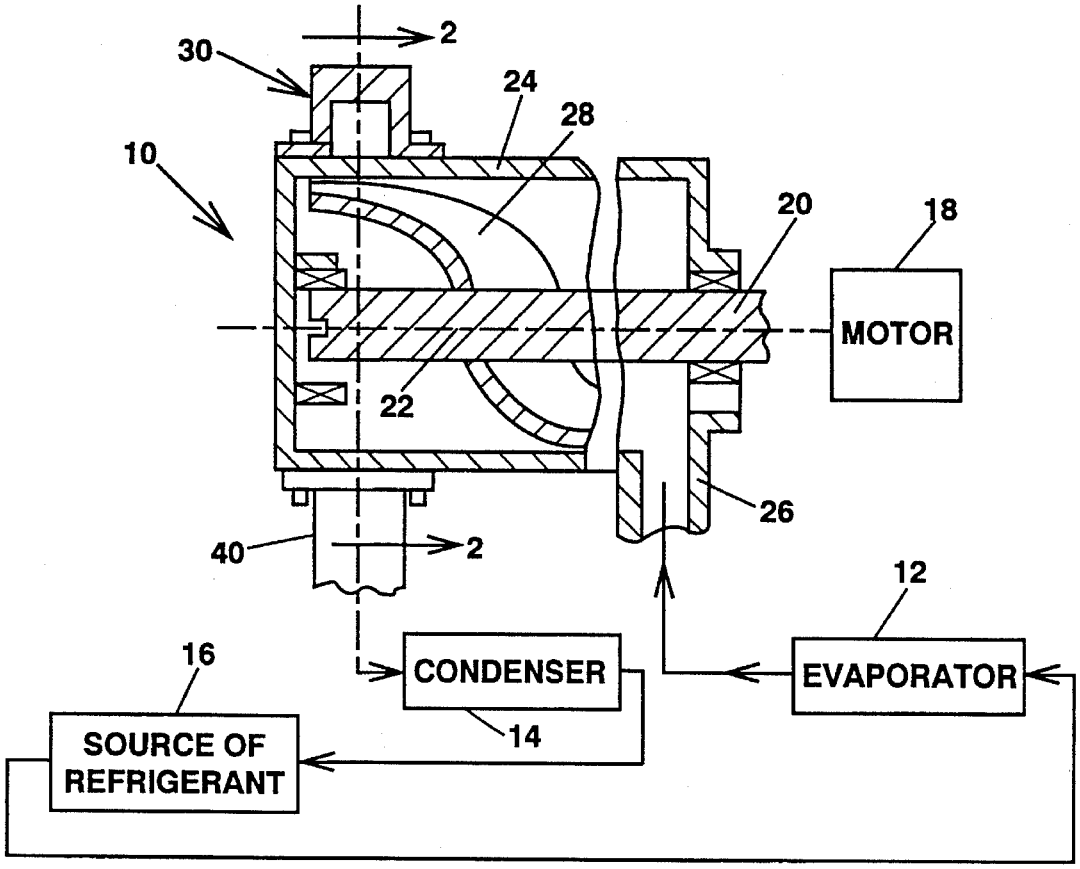

Referring now to the drawing in detail, FIG. 1 illustrates a positive displacement type of compressor, generally referred to by reference numeral 10. According to one embodiment the compressor 10 is installed in a refrigeration system by interconnection between its evaporator 12 and condenser 14, the refrigeration system also having a source of refrigerant 16 as diagrammatically shown in FIG. 1. Also diagrammed in FIG. 1 is a motor 18 driving the compressor for operation thereof. The refrigerant is accordingly drawn from source 16 through the evaporator 12 by operation of the compressor 10 to absorb heat from a refrigerated zone, and deliver the refrigerant to the condenser 14 before return to the source 16.

The compressor 10, as shown in FIG. 1, has a rotor shaft 20 driven by the motor 18 for rotation about an axis 22 established by its rotational support within a pressure-sealed housing 24 having an inlet port 26 connected to the evaporator 12 to receive fluent material therefrom in the form of refrigerant under a relatively low pressure. A single screw or helix type of impeller blade 28 is fixed to the rotor shaft 20 within the housing 24 so as to centrifugally displace the refrigerant outwardly from the housing 24 with a radial velocity component into a flow controlling muffler 30 fixed to the housing adjacent one axial end thereof axially spaced from the inlet port 26.

Figure 2:
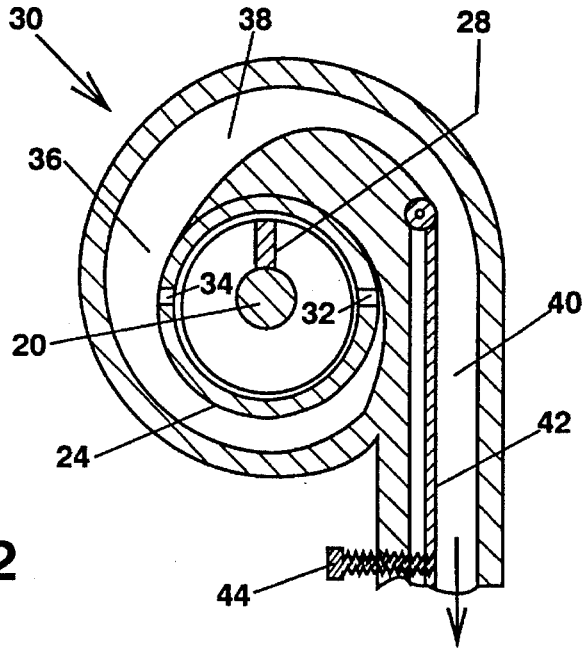

As shown in FIG. 2, the housing 24 is provided with a pair of outlet ports 32 and 34 spaced 180° apart, from which the refrigerant is delivered with a radial velocity component into an arcuate collector portion 36 of increasing cross-sectional flow area from port 34 along, a single continuous flow passage of muffler 30. The refrigerant flow stream follows a smooth volute-shaped, direction-changing flow path within the flow passage through a diffuser portion 38 thereof having a minimum cross-sectional throat. The flow passage then cross-sectionally increases in flow area from the diffuser portion 38 through an adjustable discharge duct portion 40 in a direction perpendicular to the radial outflow of the refrigerant from ports 32 and 34.

According to the embodiment shown in FIG. 2, the cross-sectional flow area of duct portion 40 may be changed by adjustable displacement of an internal passage wall 42 through adjustment control 44 in order to change flow passage geometry within the muffler 30. Such capability for adjustable change in flow passage geometry is desirable so as to accommodate different installational conditions with which the compressor 10 may be associated. Efficiency optimized operation for different installations of the compressor 10 is thereby achievable. Thus, in addition to the refrigeration system described, the compressor 10 may be adapted for optimized operation for example in various AC power installations and as a pump, with increased efficiency and reduced noise level from vibrations.

Obviously, other modifications and variations of the present invention may be possible in light of the foregoing teachings. It is therefore to be understood that within the scope of the appended claims the invention may be practiced otherwise than as specifically described.

What is claimed is:

1. A rotary compressor of the type that includes a housing having a discharge muffler within which delivery of a centrifugally driven refrigerant is received and a diffuser through which kinetic energy in the refrigerant is converted to pressure; the improvement residing in said discharge muffler having a continuous volute-shaped flow passage within which the diffuser is established, the flow passage further including a collection portion within which the centrifugally driven refrigerant is received and conducted to the diffuser; and an outlet duct portion through which the refrigerant is discharged from the diffuser in a direction substantially perpendicular to said delivery thereof to the collection portion.

2. The compressor as defined in claim 1 including adjustable means mounted in the flow passage for variation in flow geometry thereof to accommodate installational conditions of the compressor.

3. The compressor as defined in claim 2 wherein said adjustable means includes a passage wall section, and means movably mounting the passage wall section within the outlet duct portion of the flow passage for displacement thereof to effect said variation in flow geometry.

4. The compressor as defined in claim 3 having a single screw blade type of rotor through which the refrigerant is centrifugally driven.

5. A rotary compressor of the type that includes a housing having a discharge muffler within which delivery of a centrifugally driven fluid is received; the improvement residing in said discharge muffler having a continuous volute-shaped flow passage, including a collection portion within which the centrifugally driven fluid is received and an outlet duct portion from which the fluid is discharged in a direction substantially perpendicular to said delivery thereof to the collection portion, and adjustable means mounted in the flow passage for variation in flow geometry thereof to accommodate installational conditions of the compressor.

6. The compressor as defined in claim 5 wherein said adjustable means includes a passage wall section, and means movably mounting the passage wall section within the outlet duct portion of the flow passage for displacement thereof to effect said variation in flow geometry.

7. The compressor as defined in claim 6 having a single screw blade type of rotor through which the fluid is centrifugally driven.

8. In combination with a positive displacement compressor from which fluent material is delivered to a receiver, including: a centrifugal rotor, a housing enclosing the rotor and having outlet ports from which the fluent material is discharged and muffler means connected to the housing for receiving the fluent material therefrom in response to rotation of the rotor, the improvement residing in said muffler means including: passage means for conducting the pressurized fluent material from the outlet ports to the receiver along a single continuous volute-shaped flow path minimizing pulsations of the fluent material delivered to the receiver.

9. The compressor as defined in claim 8 further including flow controlling diffuser means within the volute-shaped passage means tier conversion of kinetic energy acquired by the fluent material discharged from the outlet ports into pressure.

10. A rotary fluid pump comprising in combination: a housing forming a pressure-sealed chamber having a fluid inlet in communication therewith; a rotatable impeller located within said chamber; a fluid outlet passage extending from said chamber and having a diffuser throat section, a discharge duct section downstream of the diffuser throat section, and a collection section upstream of the diffuser section in communication with said chamber; and adjustment means for varying the discharge duct section in cross-sectional flow area to accommodate installational conditions of the pump.

11. The pump of claim 10 wherein the fluid outlet is formed by a continuous volute-shaped flow passage within which the collection, diffuser throat and discharge duct sections are established.

12. The pump of claim 11 wherein said communication of the collection section with the chamber is established through at least two outlet ports in the housing from which radial outflow occurs perpendicular to outflow from the discharge duct section.

13. The pump of claim 12 wherein the volute-shaped flow passage of the fluid outlet passage extends tangentially from one of the two outlet ports.

14. A rotary compressor comprising in combination: a housing having fluid outlet ports; impeller means mounted within the housing for pressurizing fluid undergoing radial outflow from the housing through said outlet ports and muffler means receiving said radial outflow of the fluid for minimizing pulsations induced by rotation of the impeller means, said muffler means including: a continuous volute-shape flow passage having a collection section receiving said radial outflow of the fluid along a flow path converging into a diffuser throat section and an adjustable duct section downstream of the diffuser throat section from which the fluid is discharged in a direction perpendicular to said radial outflow thereof from the housing.

* * * * *